US005138985A

United States Patent [19]

Szodfridt et al.

[11] Patent Number: 5,138,985

[45] Date of Patent: Aug. 18, 1992

[54] ARRANGEMENT FOR CHANGING THE VALVE TIMING OF AN INTERNAL-COMBUSTION ENGINE

[75] Inventors: Imre Szodfridt, Stuttgart; Willi Schultz, Neulingen; Herbert Ampferer, Sachsenheim, all of Fed. Rep. of Germany

[73] Assignee: Dr. Ing. h.c.F. Porsche AG, Fed. Rep. of Germany

[21] Appl. No.: 735,006

[22] Filed: Jul. 25, 1991

[30] Foreign Application Priority Data

Jul. 28, 1990 [DE] Fed. Rep. of Germany ..... 4024057

[51] Int. Cl.[5] ..... F01L 1/34; F01L 1/04

[52] U.S. Cl. ..... 123/90.17; 123/90.31; 464/2

[58] Field of Search ..... 123/90.15, 90.17, 90.31; 464/2

[56] References Cited

U.S. PATENT DOCUMENTS 5,058,539 10/1991 Saito et al. ..... 123/90.17

FOREIGN PATENT DOCUMENTS 0245791 5/1987 European Pat. Off. .
0335083 2/1989 European Pat. Off. .
0361980 4/1990 European Pat. Off. .
4029849 3/1991 Fed. Rep. of Germany .
131808 6/1988 Japan ..... 123/90.15

*Primary Examiner*—E. Rollins Cross
*Assistant Examiner*—Weilun Lo
*Attorney, Agent, or Firm*—Evenson, Wands, Edwards, Lenahan & McKeown

[57] ABSTRACT

An arrangement for changing the valve timing of an internal-combustion engine has a camshaft, which can be rotated relative to a shaft driving it. The camshaft has a phase converter with a piston which is hydraulically acted upon on both sides. In the camshaft, an axial recess is arranged in which an inserted pipe separates two spaces from one another. An on/off valve fed from the oil circulating system, in one position, via one of the spaces, supplies the piston with pressure oil so that this piston is axially shifted into a first end position and in the process rotates the camshaft. In a second position, the piston, by way of the second space is axially pushed back by pressure oil.

16 Claims, 6 Drawing Sheets

N
N
1
20
19
21
22
22
23
24
42
D3
D2
47
24
23
44
46
46
1
42
51
42
43
43
4
4
44
D1
5
60
37
40
45
73
36
34
41
35
3
3
50
2
E1
56
55
31
53
30
52
54
F
75
32
33
74
38

N
I
24
42
20
22
19
21
23
46
43
44
45
4
5
3
2
47
51
50
74
38
32
33
75
F
61
63
62
A
31
30
60
64
65
36
37
40
41
34
35
73
E1

ARRANGEMENT FOR CHANGING THE VALVE TIMING OF AN INTERNAL-COMBUSTION ENGINE

BACKGROUND AND SUMMARY OF THE INVENTION

The present invention relates to an arrangement for the automatically controlled changing of the valve timing of an internal-combustion engine, having at least one camshaft which can be turned relative to a shaft which drives the camshaft, as a function of parameters of the internal-combustion engine. The arrangement has a wheel which drives the camshaft, carries a first toothing and, by means of a coupling member which is acted upon on both sides by an oil circulating system and is axially shiftable between at least two end positions, acts upon a second toothing connected with the camshaft via the hollow shaft. The arrangement also has chambers bordering on the coupling members, the filling and emptying of which is controlled by at least one locking element.

It is known to adapt the valve timing of an internal-combustion engine to its rotational speed in order to be able to optimally operate it in a rotational speed range that is as broad as possible. As a result, the torque, the performance, the exhaust gas emission, the idling characteristics and the fuel consumption can be improved.

One possibility of changing the valve timing during the operation of the internal-combustion engine consists of turning, by means of a so-called phase converter, preferably the intake camshaft in its position relative to the crankshaft which drives it. In this case, as a function of the oil pressure, a coupling member, which is coaxially arranged between the wheel driving the camshaft and the camshaft, is axially shifted. The coupling member carries two toothings of which at least one is helical and which interact with one corresponding toothing respectively on the camshaft or in the wheel, as known, for example, from the European Patent Document EP-0 335 083.

Phase converters are known, for example, from the European Patent Document EP-0 245 791 having a coupling member that is shifted from a first end position into a second end position and vice versa by means of a piston which is hydraulically acted upon on both sides. The piston is surrounded by an annulus divided into two control chambers which interact with a control valve via oil-carrying bores. On the one hand, this valve controls a pressure oil flow into one of the two control chambers in order to displace the piston from one end position into the other end position. On the other hand, the valve opens the oil return flow from the second, unpressurized control chamber into a tank. This phase converter requires additional space in the axial direction of the camshaft because the adjusting path of the piston is arranged completely outside the camshaft.

From the already mentioned European Patent Document EP-0 335 083, a phase converter of the above-mentioned type is known in which the control of the oil flow takes place by means of a control element which is arranged in a flanged shaft screwed to the camshaft. This control element is axially shifted by means of a solenoid and guides the oil flows to and from the control chambers in a manner analogous to the mentioned European Patent Document EP-0 245 791. The flanged shaft and the solenoid lengthen the camshaft and require additional space. In addition, the manufacturing of this phase converter is complicated and expensive.

It is an object of the present invention to provide an arrangement for changing the valve timing of an internal-combustion engine which avoids the above-mentioned disadvantages, requires as little space as possible and has a simple construction.

This and other objects are achieved by the present invention which provides an arrangement for the automatically controlled changing of valve timing of an internal-combustion engine, comprising an oil circulating system and at least one camshaft which can be rotated relative to a shaft driving the camshaft as a function of parameters of the internal-combustion engine, this camshaft being coupled to a hollow shaft having a second toothing. The camshaft has an axially extending recess and a first bore that is connected to the oil circulating system. The arrangement also has a coupling member which is acted upon on both sides by the oil circulating system and is axially shiftable between at least two end positions, and a wheel which drives the camshaft and carries a first toothing. This wheel acts via the coupling member upon the second toothing that is connected with the camshaft via the hollow shaft. First and second chambers border the coupling member, and there is at least one locking element which controls filling and emptying of the coupling member. The arrangement includes a cylindrical body in one end of the camshaft that in the axially extending cylindrical recess separates a ring-shaped exterior space. This space, in a first position of the locking element, connects the first chamber with the first bore of the camshaft during filling of the first chamber.

The present invention permits a compact construction of the phase converter and a simple design of the drive-side end of the camshaft. This is achieved by taking the locking element controlling the feeding and removal of oil out of the phase converter or the camshaft. The locking element may be arranged at any arbitrary point of the internal-combustion engine, for example, in the cylinder head and is also actuated hydraulically.

In a graduated, axially extending recess of the camshaft which is easy to manufacture, a pipe is held which separates two spaces from one another which, according to the position of the locking element, permit the feeding or the removal of oil in the camshaft or the phase converter. The spaces are connected with radial bores of the camshaft which, in turn, interact with pipes which lead into annuli of the locking element, which in certain preferred embodiments is a change-over valve.

The radial bores may be arranged at any arbitrary point of the camshaft.

The phase converter projects only slightly beyond the drive-side end of the camshaft and can be mounted as a complete constructional unit. When no phase converter is to be mounted, the camshaft may also be used by the fastening of a changed sprocket wheel.

The camshaft, which is normally made of a hard material, requires no toothing or thread.

The arrangement of the present invention requires only a small amount of oil because only the oil displaced from the chambers adjacent to the piston must be replaced for the shifting of the piston from a first end position into a second end position.

The emptying of the chambers after the switching-off of the internal-combustion engine is avoided in the present invention by providing oil-carrying pipes that are constructed as ascending pipes which prevent an oil return flow.

The actuating circulating system for the changing of the valve timing is part of the oil circulating system of the internal-combustion engine. The lubricating circulating system for the camshafts is connected to this actuating circulating system in such a manner that, when the phase converter or the locking element fails, the lubrication is maintained.

Other objects, advantages and novel features of the present invention will become apparent from the following detailed description of the invention when considered in conjunction with the accompanying drawings.

DETAILED DESCRIPTION OF THE DRAWINGS

Figures 1, 1A:
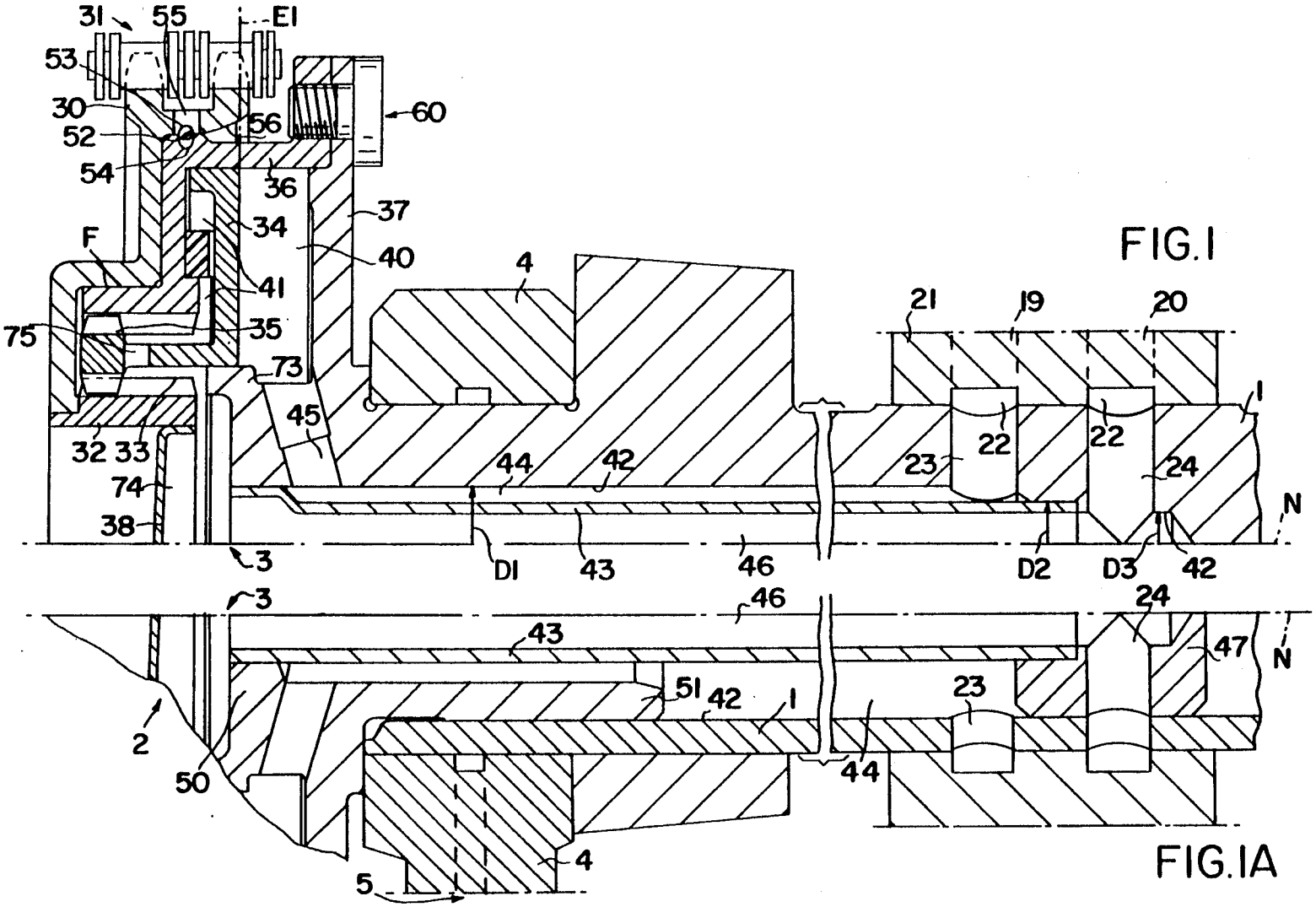
FIG. 1 is a cross-sectional view of a first embodiment of the present invention.
FIG. 1*a* is a view of the first embodiment with a modified camshaft.

In an internal-combustion engine, which is not shown in detail and which is arranged in a motor vehicle and has four overhead camshafts, a phase converter 2 is assigned on the drive side end 3 to each of the two camshafts 1 serving the intake. Each camshaft 1 is held in several bearings 4 which are connected to a lubricating circulating system 5. The oil circulating system of the internal-combustion engine comprises the lubricating circulating system 5, an actuating circulating system for the adjustment of the phase converters 2 and a lubricating system of the crankshaft 6 (FIG. 3).

Figure 3:
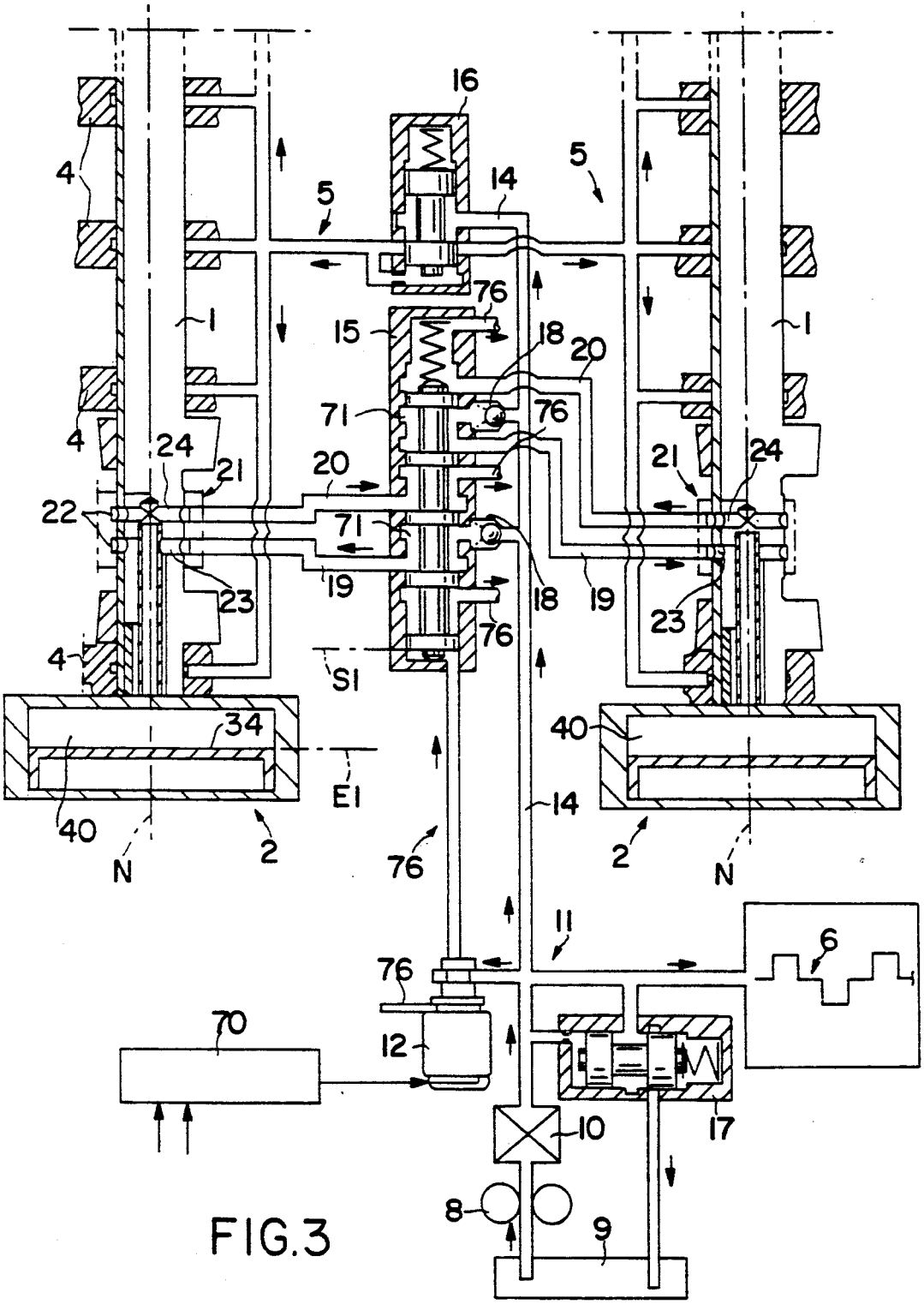
FIG. 3 is a schematic view of an oil circulating system of the arrangement of the present invention with a locking element in a first position.
Figure 4:
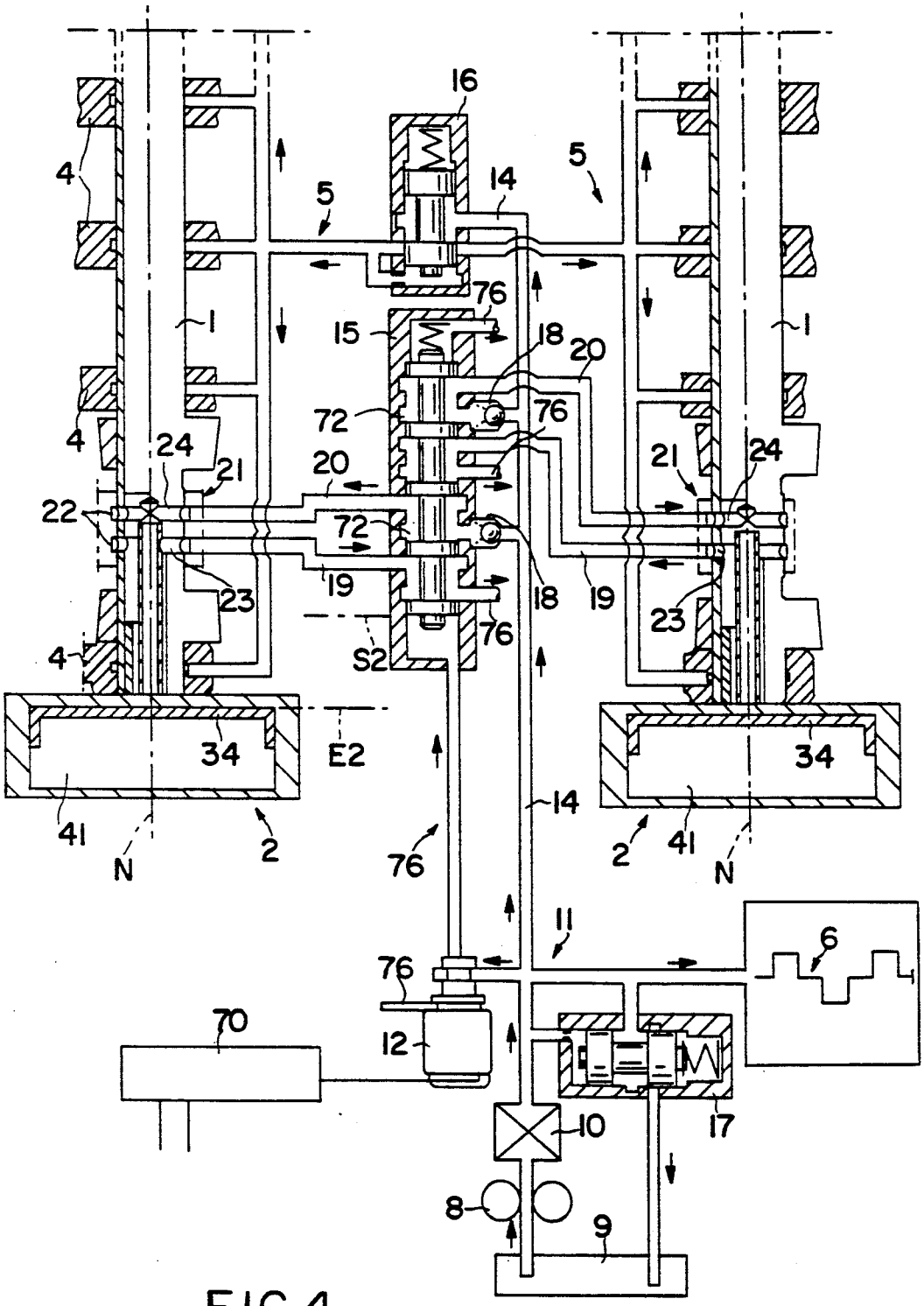
FIG. 4 is a schematic view of an oil circulating system of the arrangement of the present invention with a locking element in a second position.

As seen in FIGS. 3 and 4, a pump 8 delivers oil from a storage tank 9 through a filter 10. From there, a junction 11 leads to an on/off valve 12, to the crankshaft 6 of the internal-combustion engine and, by way of an oil-feeding duct 14, to a change-over valve 15 (a "locking element") arranged in parallel to this duct 14, as well as a pressure reducing valve 16 situated downstream.

Between the filter 10 and the crankshaft 6, a pressure relief valve 17 is connected which limits the oil pressure delivered by the pump 8 to a maximum pressure PM.

The lubricating circulating system 5 branches off from the pressure reducing valve 16 and admits a pressure P1, which is preferably lower than the pressure PM, to the bearings 4.

The change-over valve 15 has integrated check valves 18 by means of which the duct 14 can be coupled with the phase converters 2. A first and a second pipe 19 and 20 respectively lead from the change-over valve 15 to a separate bearing point 21 of the camshafts 1. By way of ring ducts 22 extending in these bearing points 21, a connection takes place with first and second bores 23 and 24 extending radially in the camshafts 1.

The phase converter 2 comprises three normally used elements which engage with one another by way of toothings. It comprises a wheel 31 which is constructed as a sprocket wheel 30 and serves for the drive of the camshaft 1. An interior hub 32, which carries a first helical toothing 33, is welded into the wheel 31. By way of the first toothing 33, the wheel 31 is connected with a coupling member constructed as a piston 34 which is hydraulically acted upon on both sides. The coupling member 34 is axially displaceable into two end positions E1, E2 with respect to the axis N extending longitudinally and centrically in the camshaft 1 (see FIGS. 3 and 4). The piston 34 carries a second helical external toothing 35, which engages in a corresponding toothing of a hollow shaft 36 which is connected with a flange 37 of the camshaft 1. A cap 38 is pressed into the interior hub 32.

Figures 2, 2A:
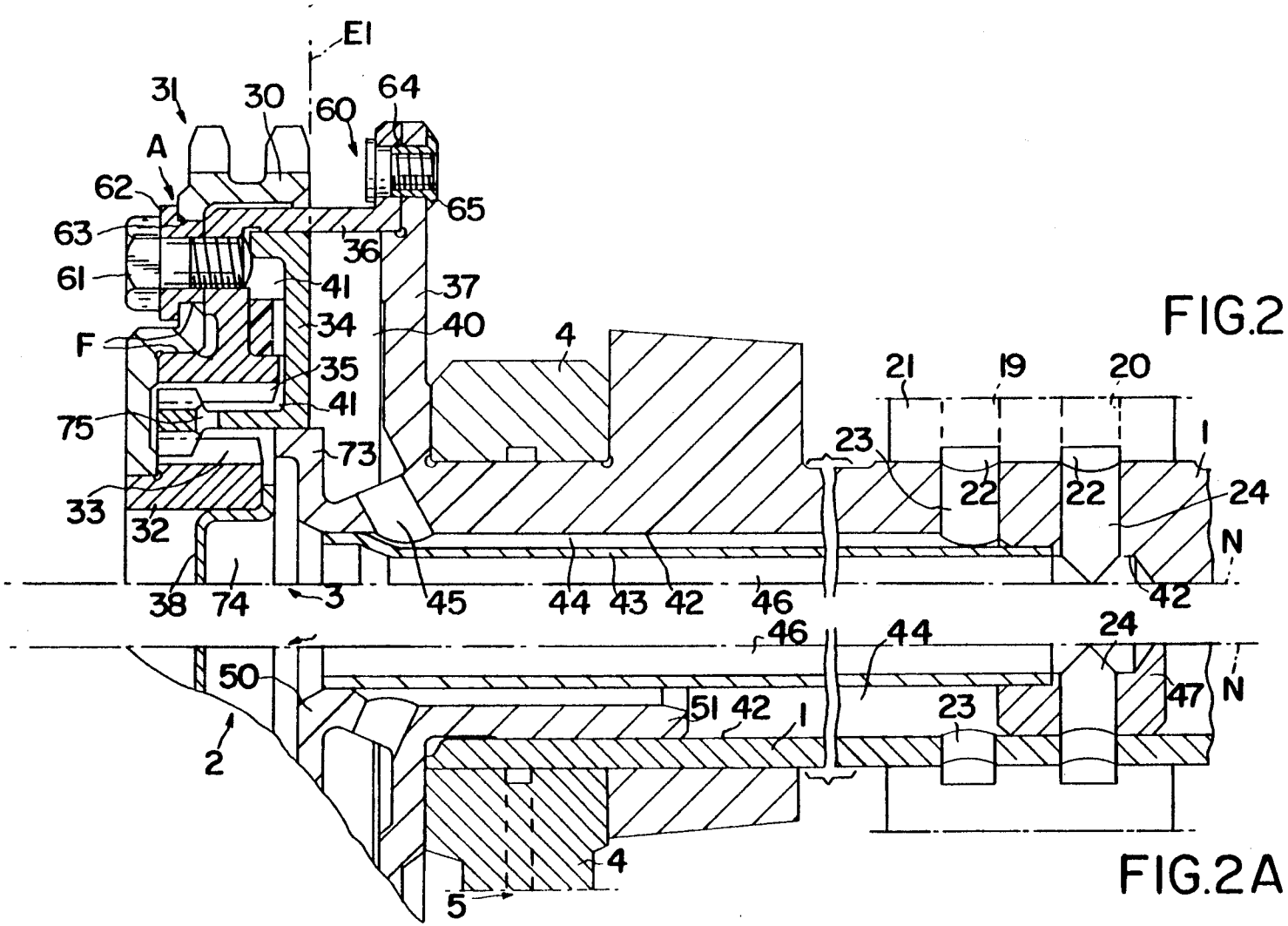
FIG. 2 is a cross-sectional view of a second embodiment of the present invention.
FIG. 2*a* is a view of the second embodiment with a modified camshaft according to FIG. 1*a*.

The piston 34 divides a volume enclosed between the flange 37 and the hollow shaft 36 into a first chamber 40 and a second chamber 41. In FIG. 1 and FIG. 2, the piston 34 is in a first end position E1 which, during the operation of the internal-combustion engine, is taken up in a first operating condition, such as idling.

FIG. 1 illustrates a first embodiment while below the axis N, FIG. 1*a* shows the first embodiment with a modified camshaft 1.

A cylindrical graduated recess 42, which extends from the end 3 rotationally symmetrically to the axis N, is provided in the camshaft 1 shown above the axis N. From the end 3 to directly behind the first bore 23, the recess 42 has a first diameter D1. Between the bores 23, 24, the recess 42 has a second smaller diameter D2, and from there to directly behind the second bore 24, a still smaller diameter D3. In the recess 42, a pipe 43 is held as a cylindrical body which is radially widened to the diameter D1 at the end 3 and otherwise has the diameter D2. The pipe 43 therefore separates a ring-shaped exterior space 44 inside the recess 42 into which the first bore 23 leads and which, at the end 3, by way of an almost radially extending connecting bore 45, is connected with the first chamber 40. The second bore 24 intersects the recess 42 in the area of the diameter D3 and is connected with an interior space 46 extending inside the pipe 46.

In a modification shown in FIG. 1*a*, a built-up hollow camshaft 1 is shown into which a bushing 47 is inserted. The pipe 43 extends in the recess 42 in a straight line and, at the end 3, is held in a collar 50 of the separately constructed flange 37, which is inserted into the camshaft 1 by means of a sleeve 51. At its other end, the pipe 43 is held in the bushing 47. The second bore 24 extends partially in the bushing 47 and is, in turn, connected with the interior space 46. The exterior space 44 formed between the pipe 43 and the sleeve 51 or the recess 42 connects the first bore 23 with the first chamber 40.

In the first embodiment according to FIG. 1 and FIG. 1*a*, the sprocket wheel 30 is axially fixed on the hollow shaft 36 by means of a prestressed spring ring 52. Half of the spring ring 52 is disposed in a semicircular groove 53 of the sprocket wheel 30, and the other half is disposed in a turned groove 54 of the hollow shaft 36, the depth of which is at least twice as large as that of the groove 53. The spring ring 23 is accessible by way of several assembly openings 55.

During the mounting, the spring ring 52 is placed in the turned groove 54 into which half of it dips because of its prestressing. Subsequently, the sprocket wheel 30 is pushed onto the hollow shaft 36, in which case a molded-on slope 56 presses the spring ring 52 completely into the turned groove 54 before, when the turned groove 54 and the groove 53 cover one another, half of it is placed in this groove 53. Subsequently, the phase converter 2, as a constructional unit, is fastened to the flange 37 by means of screwed connections 60.

In a second embodiment of the invention according to FIG. 2 and FIG. 2*a*, the sprocket wheel 30 is axially secured on the hollow shaft 36 by means of screws 61. These screws 61 are screwed into threads of the hollow shaft 36 and, by means of guide sleeves 62, are slidingly guided in oblong holes 63 of the sprocket wheel 30. In this case, a slight axial play A remains between the guide sleeve 62 and the wheel 31.

The phase converter 2 is held with screwed connections 60 in oblong holes 64 of the flange 37 by means of squeezing sleeves 65. The oblong holes 64 permit a positionally correct mounting of the phase converter 2 irrespective of the position of the camshaft 1 which for the mounting is secured against turning.

The modification shown in FIG. 2*a* is identical with the first embodiment according to FIG. 1*a*. In this case, the camshaft 1 is constructed of piece parts. The flange 37 is inserted separately, and the recess 42 is axially bounded by a bushing 47.

During the operation of the internal-combustion engine, the pump 8 delivers oil from the storage tank 9 through the filter 10 to the junction 11. The on/off valve 12 is switched on or off by an electronic control unit 70 as a function of input signals representing the parameters of load and rotational speed of the internal-combustion engine.

In the switched-off condition, no oil from the junction 11 reaches the change-over valve 15 by way of the on/off valve 12. The change-over valve 15, in a spring-loaded condition, is situated in a first position S1 which corresponds to the end position E1 of the piston 34. The oil which, by means of pressure, is conveyed through the duct 14 in the direction of the illustrated arrows, opens up the check valves 18 so that the oil flows, by way of first annuli 71, into the first pipes 19 and from there into the first bores 23. From the direction of the bore 23, the pressure acts through the exterior space 44 and the connecting bore 45, on a first chamber 40 and holds the piston 34 in its first end position E1.

In a second operating condition of the internal-combustion engine, for example, a medium rotational speed range, the control unit 70 switches on the on/off valve 12 so that, from the direction of the junction 11, oil flows by way of the on/off valve 12, to the change-over valve 15 and shifts it into a second position S2 which corresponds to the end position E2 of the piston 34. The oil, which by way of the check valves 18, flows into the second annuli 72, will now, by way of the second pipes 20, reach the second bores 24. From there, the pressure acts, through the interior space 46, on the second chamber 41. In this case, the oil flows from the open end of the pipe 43 into a hollow space 74 formed by a radial flange 73 and the cap 38 and, from there, by way of openings 75 in the piston 34, into the second chamber 41. In this case, the piston 34 is axially displaced into the second end position E2, in which case, by way of the two helical toothings 33, 35, the sprocket wheel 30 is turned relative to the camshaft 1. In this case, rotational displacements occur in the phase converters 2 between the components bordering on the sliding surfaces F.

The oil volume, which was displaced from the first chamber 4 during the shifting from the end position E1 into the end position E2, flows via the connecting bore 45, the exterior space 44 and the first bore 23, into the ring duct 22 and from there, flows off by way of the first pipe 19.

In the two end positions E1, E2 of the change-over valve 15, the annuli 71, 72, which receive oil flowing back from the phase converters 2, are connected with ascending pipes 76 which geodetically lead out above the phase converters 2 in the internal-combustion engine so that, after the switching-off of the internal-combustion engine an emptying of the actuating circulating system is prevented.

During the adjustment of the piston 34 from the end position E2 into the end position E1, the oil displaced from the second chamber 41 flows through the openings 75, the hollow space 74, the interior space 46 and the second bore 24 into the ring duct 22 and from there, by way of a second pipe 20, into the annulus 71.

During an operation of the internal-combustion engine at low rotational speeds, the pump 8 does not deliver any maximum pressure PM. If, in this case, a shifting of the piston 34 should nevertheless be necessary, the check valves 18 cause a gradual filling of the annuli 71, 72. As a result, the piston 34 is shifted from one end position into the other end position in a graduated manner.

Instead of the change-over valve 15 being assigned to two camshafts 1, one separate actuating circulating system respectively may be assigned to the two camshafts 1 in another embodiment of the invention. In this case, a duct 14, a change-over valve 15 with a check valve 18 as well as a pressure reducing valve 16 are assigned to each camshaft 1.

Figure 5:
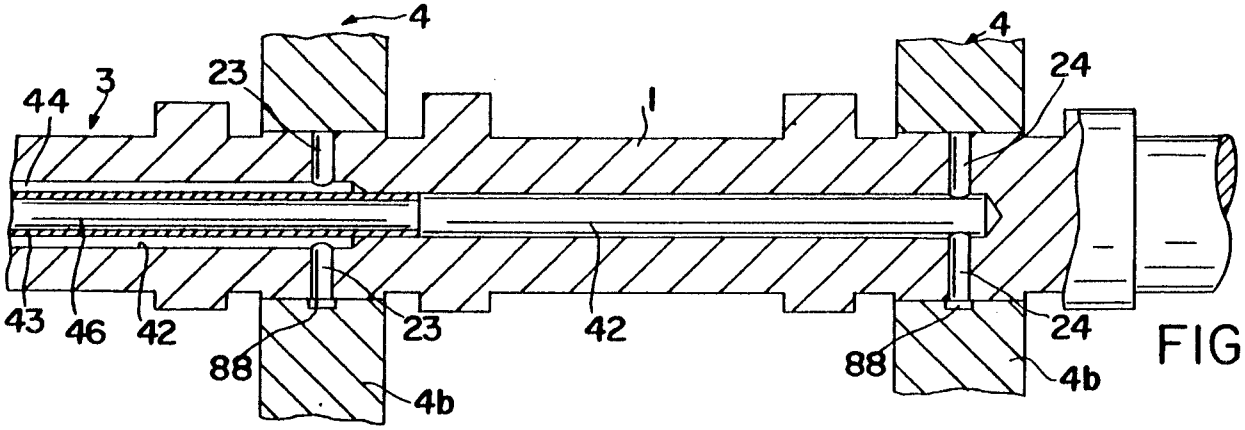
FIG. 5 is a cross-sectional view of the camshaft of a third embodiment.

In a third embodiment of the invention according to FIG. 5, no separate bearing point 21 is required in order to ensure the feeding and the removal of oil in the camshaft 1. The radial first and second bores 23, 24 are arranged at points of the camshaft 1 which are supported in the bearings 4.

Figure 7:
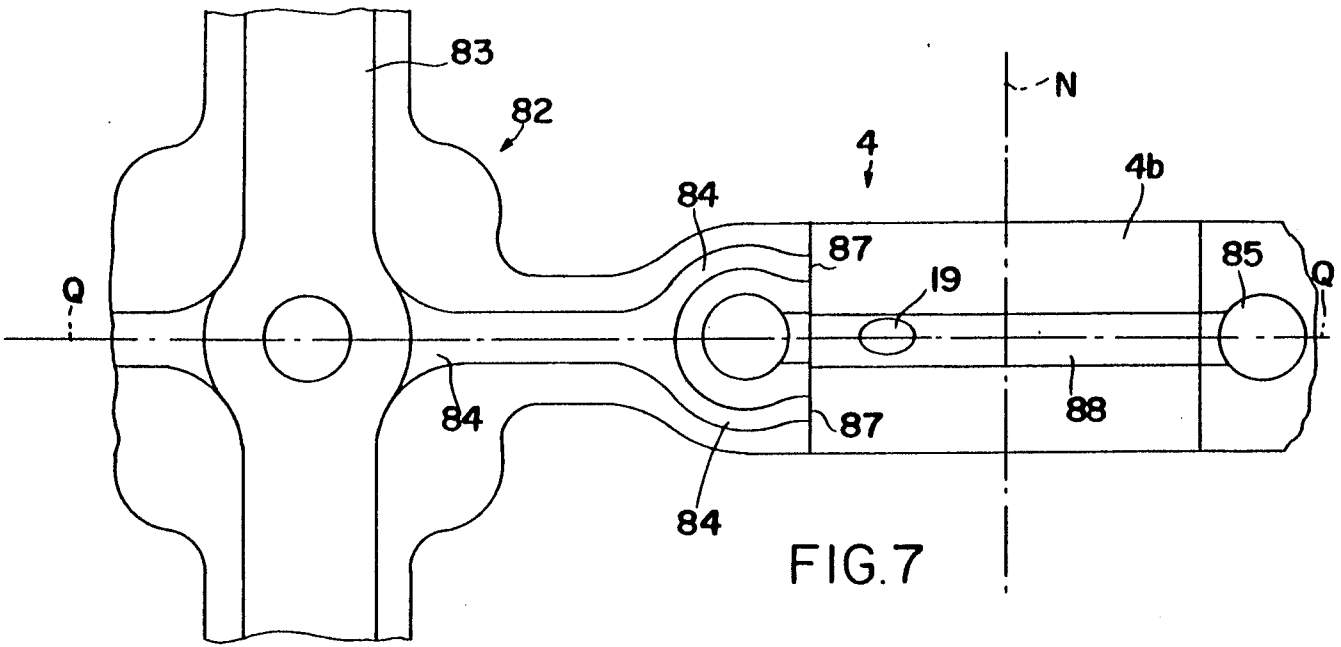
FIG. 7 is a sectional view along Line VII—VII according to FIG. 6.
Figure 6:
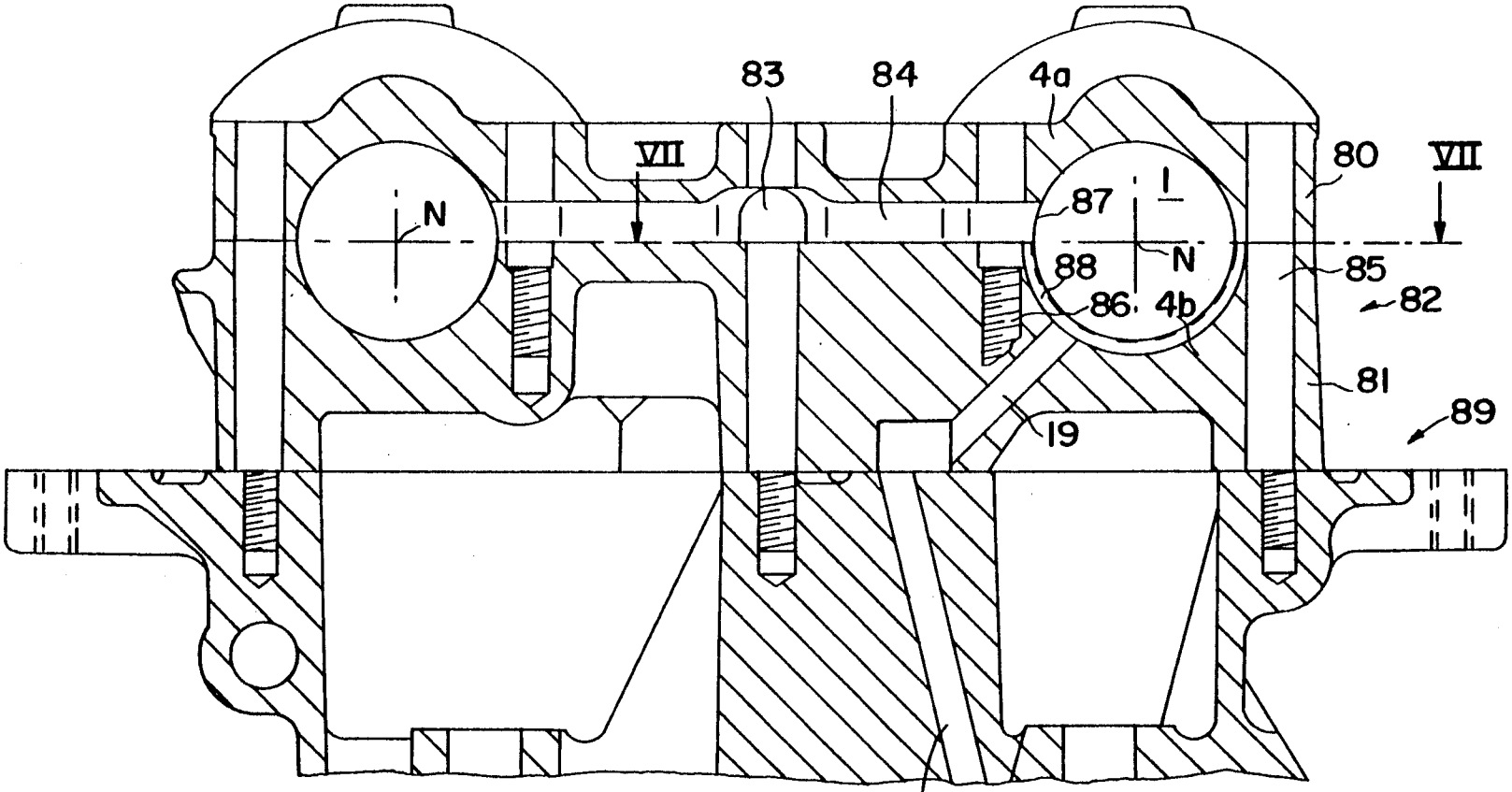
FIG. 6 is a cross-sectional view of a cylinder head of an internal-combustion engine with the third embodiment.

The bearings 4 are, in each case, constructed as an upper and a lower half 4*a*, 4*b* in a top part 80 and a bottom part 81 of a bearing frame 82 for camshafts (FIGS. 6 and 7). In the top part 80, ducts 83, 84 extend as part of the lubricating circulating system 5. From the duct 83, which is situated downstream of the pressure reducing valve 16 and extends in parallel to the axis N in the top part 80, ducts 84 branch off rectangularly in a transverse plane Q to each bearing 4. Bore 85 receive screwed connections 86 for the fastening of the top part 80 on the bottom part 81. The ducts 84 are guided in a ring-shaped manner around the bores 85 situated between the axis N and the duct 83 so that the oil with the pressure P1 adjacent to the transverse plane Q, by way of two lubricating openings 87, supplies the bearing 4 in its upper half 4*a*.

The supplying of the exterior space 44 and the interior space 46 takes place analogously to the first two embodiments of the invention, but the pipe 19 leading to the first bore 23 is arranged in a first bearing 4, and the pipe 20 leading to the second bore 24 is arranged in a second bearing which is adjacent to the first bearing 4. The lower halves 4*b* each have a groove 88 which according to FIG. 7 is arranged symmetrically with respect to the transverse plane Q between the lubricating openings 87. The first pipe 19 leads into this groove 88, and the second pipe 20 leads into the groove 88 of a second bearing 20.

According to FIG. 6, the bearing frame 82 is fastened to the side of a cylinder head 89, which faces away from the combustion spaces and in which some of the pipes 19, 20 of the actuating circulating system are arranged.

By means of the above-described embodiment, the parts of the lubricating circulating system 5 and of the actuating circulating system, which are arranged in a bearing 4, and thus also the different oil pressures P1, PM are separated from one another. Also in this embodiment, the camshaft 1 can be used in the modified form according to FIGS. 1*a* and 2*a*. In this case, the length of the bushing 47 is constructed corresponding to the distance between two adjacent bearings 4.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for the automatically controlled changing of valve timing of an internal-combustion engine, comprising:

an oil circulating system;

at least one camshaft which can be rotated relative to a shaft driving the camshaft as a function of parameters of the internal-combustion engine, said camshaft being coupled to a hollow shaft having a second toothing, said camshaft having an axially extending recess and a first bore that is connected to the oil circulating system;

a coupling member which is acted upon on both sides by the oil circulating system and is axially shiftable between at least two end positions, a wheel which drives the camshaft and carrying a first toothing, said wheel acting via the coupling member upon the second toothing that is connected with the camshaft via the hollow shaft;

first and second chambers which border the coupling member;

at least one locking element which controls filling and emptying of the first and second chambers bordering the coupling member; and a cylindrical body in one end of the camshaft that in the axially extending cylindrical recess separates a ring-shaped exterior space, said space, in a first position of the locking element, connecting the first chamber with the first bore of the camshaft during filling of the first chamber.

2. An arrangement according to claim 1, wherein the locking element is a change-over valve, and in a second position of the change-over valve, the first chamber during emptying is connected with the first bore.

3. An arrangement according to claim 2, wherein in the first and second positions, the second chamber, by means of an interior space enclosed by the cylindrical body, is connected with a second bore of the camshaft connected to the oil circulating system.

4. An arrangement according to claim 3, wherein the change-over valve is arranged in parallel to the oil-carrying duct of the oil circulating system and has annuli which, in the first and second positions, are connected by first and second pipes to the first and the second bores.

5. An arrangement according to claim 4, further comprising check valves arranged between the oil-carrying duct and the annuli.

6. An arrangement according to claim 2, further comprising a lubricating circulating system, and wherein the duct downstream of the change-over valve leads into a pressure reducing valve which, via the lubricating circulating system, is connected with bearings of the camshaft.

7. An arrangement according to claim 2, wherein the duct, upstream of the change-over valve, has a junction which is connected with a pump, the change-over valve, an on/off valve and the lubricating circulating system.

8. An arrangement according to claim 7, further comprising a control unit, and wherein the on/off valve, as function of engine parameters shifts the change-over valve between the first and second positions.

9. An arrangement according to claim 1, further comprising at least two camshafts, wherein a change-over valve with a check valve and a duct with a pressure reducing valve is assigned to each camshaft.

10. An arrangement according to claim 1, further comprising a radially prestressed spring ring that axially holds the wheel on the hollow shaft.

11. An arrangement according to claim 10, wherein the wheel has a groove and the hollow shaft has a turned groove, and wherein half of the spring ring is arranged in the groove of the wheel and the other half of the spring ring is arranged in the turned groove of the hollow shaft.

12. An arrangement according to claim 1, wherein the wheel has oblong holes, and the wheel is axially held on the hollow shaft by screws that penetrate the oblong holes through guide sleeves.

13. An arrangement according to claim 12, wherein a small axial play exists between the guide sleeve and the wheel.

14. An arrangement according to claim 3, wherein the recess has a first diameter from the end along an axis to behind the first bore, has a smaller second diameter between the first and second bores, and has a still smaller third diameter from between the first and second bores to behind the second bore.

15. An arrangement according to claim 3, wherein the first and second bores are arranged inside a separate bearing point of the camshaft.

16. An arrangement according to claim 3, wherein the first bore leads into a groove of a first bearing of the camshaft and in that the second bore leads into a groove of a second bearing situated adjacent to the first bearing.

* * * * *